US007047958B1

(12) United States Patent
Colley

(10) Patent No.: US 7,047,958 B1
(45) Date of Patent: May 23, 2006

(54) COMPACT ARCHERY COMPOUND BOW WITH IMPROVED EFFICIENCY FEATURES

(76) Inventor: David E. Colley, 1715 Ozora Rd., Loganville, GA (US) 30052

( * ) Notice: Subject to any disclaimer, the term of this patent is extended or adjusted under 35 U.S.C. 154(b) by 174 days.

(21) Appl. No.: 10/653,284

(22) Filed: Sep. 3, 2003

(51) Int. Cl.
*F41B 5/10* (2006.01)

(52) U.S. Cl. ..... 124/25.6

(58) Field of Classification Search ..... 124/23.1, 124/25.6
See application file for complete search history.

(56) References Cited

U.S. PATENT DOCUMENTS 3,854,467 A * 12/1974 Hofmeister ..... 124/25.6
3,967,609 A 7/1976 Frydenlund
3,987,777 A 10/1976 Darlington
3,993,039 A * 11/1976 Groves et al. ..... 124/25.6
4,077,385 A 3/1978 Fredrickson
4,457,287 A 7/1984 Babington
4,461,267 A * 7/1984 Simonds et al. ..... 124/25.6
4,757,799 A 7/1988 Bozek
4,781,168 A * 11/1988 Lester ..... 124/25.6
4,858,588 A 8/1989 Bozek
4,903,677 A 2/1990 Colley
5,024,206 A 6/1991 Lester
5,054,463 A 10/1991 Colley et al.
5,150,699 A 9/1992 Boissevain
5,353,777 A 10/1994 Fincher
5,388,564 A 2/1995 Islas
5,503,135 A 4/1996 Bunk
5,638,804 A * 6/1997 Remick et al. ..... 124/25.6
5,651,354 A 7/1997 La Haise, Sr.
5,720,267 A * 2/1998 Walk ..... 124/23.1
5,791,322 A 8/1998 McPherson
5,890,480 A 4/1999 McPherson
5,901,692 A 5/1999 Allshouse et al.
5,950,609 A 9/1999 Thielen et al.
5,967,132 A * 10/1999 Loomis ..... 124/25.6
5,979,425 A 11/1999 Loomis
6,067,974 A * 5/2000 Islas ..... 124/25.6
6,244,259 B1 * 6/2001 Adkins ..... 124/23.1
6,257,220 B1 7/2001 McPherson et al.
6,415,780 B1 7/2002 Proctor

* cited by examiner

*Primary Examiner*—John A. Ricci
(74) *Attorney, Agent, or Firm*—Shoemaker and Mattare

(57) ABSTRACT

A compound archery bow includes a rigid riser with, at either end, a pair of side plates which support a spool assembly that includes a bowstring spool and a cam spool which rotate together. As an archer draws the bowstring back, the bowstring spool rotates the cam spool, which reels drive cable off of the major lobe of a cam assembly at the same end of the bow, while the minor lobe of the assembly reels in a buss cable attached to the bow limb tip, flexing the limb.

11 Claims, 5 Drawing Sheets

COMPACT ARCHERY COMPOUND BOW WITH IMPROVED EFFICIENCY FEATURES

BACKGROUND OF THE INVENTION

The present invention is an archery bow which represents an improvement over my U.S. Pat. Nos. 4,903,677 and 5,054,463. The object of those patents was to provide a compound type bow of a more compact size, as compared to conventional compound type bows, while offering all of the features of a full size bow with respect to performance, range of draw length, accuracy, and other parameters.

I have found, however, that while my prior patents do indeed provide ways of reducing the overall size of a compound type bow dramatically without sacrificing the ability to provide the longest draw length required, certain aspects of the design act to inhibit performance while other aspects enhance performance, but not enough to compensate for the performance-degrading aspects.

The present invention provides an improved compound bow incorporating those features of the previous design that successfully accomplish the goal of providing for ultra-compact size while improving the bow by eliminating those characteristics of the previous design that were detrimental to performance.

In order for a compound bow to be successful, it must be capable of producing an acceptable level of performance in terms of both arrow velocity and accuracy. Acceptable performance with respect to arrow velocity is not a subjective issue: arrow velocity must meet standards established by the Archery Manufacturers Organization (AMO) to be successful in the marketplace. The AMO standard for determining arrow velocity specifies using a 60 lb. peak draw weight, a 30 in. draw, and a 540 grain arrow. Recent bows tested under this standard produce arrow velocities in the range of 200 to 250 feet per second. My prior designs could not meet this velocity standard.

Accuracy, on the other hand, can be considered subjective, because the accuracy obtainable with any given bow is the product not of the bow alone, but rather the bow/arrow/archer combination. However, some characteristics of a bow design tend to enhance accuracy, and some may tend to detract from it.

The present invention goes well beyond the correction of deficiencies inherent in my previous design.

In my prior U.S. Pat. No. 4,903,677, flat, wound, power spring type components were used to store energy in the bow. I have found that while this configuration can fulfil its function of propelling an arrow, satisfactory arrow velocity is not attainable because the flat, wound spring produces high levels of hysteresis resulting from of the friction between neighboring coils in operation. The hysteresis exceeds that which would allow an acceptable level of energy to be transmitted to the arrow. In order to benefit from the energy curve produced by a power spring in terms of its relationship to the force/draw characteristics required, the unsprung mass of the power spring must be so great that, as a contributing factor to the overall mass weight of the bow, it is impractical as a means of storing energy.

In one embodiment of U.S. Pat. No. 5,054,063, flexible limbs were used in conjunction with power springs to store energy. This configuration suffers the same deficiency described in the previous paragraph.

Another embodiment in U.S. Pat. No. 5,054,063 eliminated the power springs, and relied completely on flexible limbs to store energy. That configuration eliminated any problems associated with the use of power springs and would appear to provide a design that would more closely simulate the efficiency characteristic of conventional compound bow design. However, although performance was improved, it was still short of acceptable levels because of inherent characteristics that tended to inhibit dynamic efficiency. Those same characteristics are not only present in my previous design, but are actually substantially pronounced as a result of the extremely short axle-to-axle (bowtip-to-bowtip) distance.

Modern compound type archery bows are designed, generally, in one of two configurations. The older configuration, commonly referred to as the two-cam bow, has a cam component located at each limb tip. In a two-cam bow, each cam has two cam lobes of different size and profile. The larger of the two lobes has a length of bowstring entrained around a portion of its perimeter; this portion is extracted during the draw, causing the cam to rotate. The second, and relatively smaller, lobe of the cam anchors a buss cable whose other end is anchored to the limb tip. Upon drawing the bowstring, the buss cables are wound onto the smaller lobes thereby drawing the opposing limb tips closer together. The deflection caused in the limbs represents stored potential energy which propels the arrow upon release of the bowstring.

The newer variety of compound bow is called the one-cam bow. It also deflects the two limbs to store energy. However, the one-cam bow does so with a different arrangement of cables and bowstring. The one-cam bow has only one cam located at the tip of the lower limb, with a simple idler pulley replacing the cam at the tip of the upper limb. The cam of the one-cam bow has three, not two, lobes. One of the three lobes acts much like the lesser lobe of the two-cam bow in that, upon rotation of the cam, a buss cable that extends between that lobe and the upper limb tip, is wound onto the lobe, deflecting the limb in much the same manner as the two-cam arrangement. The remaining two lobes of the one-cam bow cam are of different size and configuration. The larger of the two pays out bowstring to the archer draw much like in the two-cam arrangement. The lesser of the two remaining lobes, however, also pays out bowstring, but to an idler at the upper limb tip where the bowstring is entrained around the idler and represents the feed of the bowstring to the draw. Because one lobe that feeds bowstring is considerably larger in profile than that of the second feeder lobe, the amount of bowstring extending from the cam to the idler is essentially shortened during the rotation of the cam and thus contributes to the deflection of the limbs and the subsequent storing of energy.

The design of the configuration of each cam lobe, whether that of a one or two cam arrangement, defines the amount of energy stored in terms of the incremental measurement of force required to draw the bowstring from its initial position to the position at full draw. Configurations of cams vary and produce different draw/force characteristics representing various levels of stored energy. The criteria used in the design of cams for compound bows is commonly known within the art and, while a certain amount of experimentation may be required, a satisfactory cam design for either a one or two cam bow is relatively easy to obtain.

Great advancements have been made in the design of limbs, riser handles, bowstrings and buss cables, bearings, and other components. However, it is generally accepted that the amount of stored energy that is determined by the cam and subsequently transferred to the arrow is the principal factor in arrow velocity, that is, the more energy delivered to the arrow, the faster it will be propelled. Of course, the unfortunate fact remains that the more energy that is available to the arrow means that the more energy is required to draw the bow. Arrow velocity may vary somewhat from one bow to another, each exhibiting the same level of stored energy and same peak draw weight. This is due to the differences in other factors such as overall bow geometry, levels of hysteresis, and the manner in which the energy is defined in the draw. Nevertheless, it has been accepted that a bow capable of producing a given arrow velocity must store a given amount of energy.

Several factors that affect arrow velocity as well as accuracy and overall performance in a compound type bow have, however, been overlooked or ignored altogether as a result of certain limitations inherent in the conventional design of compound bows.

One such factor, and a surprisingly substantial factor affecting arrow velocity, is that of the relationship of the rotational speed (r.p.m.) of revolving components, to the reaction time of the limbs. This effect may be described, to some extent, in terms of the time required for the limbs to return from their fully deflected position at full draw back to their starting position and the speed at which the cam rotates and how this relates to the speed of travel of the bowstring. The reaction of the limbs returning to brace is essentially the driving mechanism to produce rotation of the cam or cams during launch. The cams' rotational speed defines the speed of bowstring travel as it is retracted onto the cam lobes. This bowstring travel speed is influenced by the ratio of the varying radius of the cam lobe being driven by the limb to that of the lobe that is drawing up bowstring.

In order to achieve a force/draw relationship by virtue of cam design that represents an acceptable level of stored energy to produce an acceptable range of arrow velocity, it is necessary that the relationship of one cam lobe to another be such that the potential energy produced by the deflection of the limbs is defined in terms of the force of draw in a structured manner. In order to achieve such structured characteristics, it is necessary that, from the braced position at the commencement of the draw, the length of radius of the lobe of the cam that directly produces limb deflection is substantially longer than the length of the radius of the lobe from which bowstring is extracted. Throughout the draw, the relationship of the length of one cam lobe radius to the other constantly changes creating a graduated progression of ratio relationships that progressively alter the moments of torque on the cam throughout the rotation of the cam. At full draw, in order to achieve the necessary compounding characteristics of the draw, the length of the radius of the lobe from which bowstring is extracted must now be substantially longer than the length of the radius of the lobe directly deflecting the limb. The basic principles of cam design for compound bows have their origin in the U.S. Pat. No. 3,486,495 issued to H. W. Allen, and are well known. However, while these principles successfully accomplish the goal of defining and controlling the distribution of stored energy throughout the draw, they ignore the effect of the ratio of one cam lobe to the other in terms of the effect on the speed of bowstring travel.

To examine this effect further, we must examine the sequence of events from release of the bowstring to the point at which the arrow leaves the bowstring at brace. During the draw, the archer represents the driving component with respect to cam rotation. Upon release of the bowstring, the limbs become the driving component. During the brief, initial stages of launch, the limbs are driving the very small radius of one cam lobe that, by virtue of being integrally attached to the associated cam lobe, is essentially driving a lobe of considerably larger radius. At this interval, the speed of the bowstring travel is substantially greater than that of the speed of the cable, the speed of the cable being directly proportional to the speed of recovery of the limb. However, as the sequence of ratio relationships of one lobe to the other progresses through the launch, the effect of amplification of rate of travel of the bowstring as related to the rate of travel of the cable progressively diminishes and eventually reverses. In other words, the rate of bowstring travel is constantly slowing down throughout the launch as a seemingly unavoidable result of the design of the cam that is necessary to achieve the desired draw/force characteristics. Because this aspect of influence upon arrow velocity appears to be unavoidable, it has either been unrecognized or ignored altogether. Of course, if the relationship of the speed of travel of the bowstring to that of the speed of recovery of the limbs could be improved, this would improve arrow velocity. Such an improvement in arrow velocity would also demand a consideration of the fact that a substantially higher rate of arrow velocity may be attainable for a given range of stored energy beyond that exhibited with conventional compound bow design.

The present invention improves the speed of bowstring travel relative to the recovery speed of the limbs thereby overcoming the seemingly unavoidable condition inherent in conventional design as outlined above. This is accomplished through the implementation of the take-up spool/cam drive wheel component of the previous design for the purpose of providing an additional, intermediate ratio that offsets or compensates for the diminishing effect of the cam with respect to the rate of speed of bowstring travel. The take-up spool/cam drive wheel component of the previous design was intended solely as a means of reducing the overall size of a compound bow and in the patent(s) pertaining to the previous invention, this component was not recognized as a means to any other end. The present invention, however, proposes that, while the intended use of the component is incorporated for the original purpose of providing for an ultra-compact configuration, surprisingly new results are produced when that component is utilized with other elements of the invention.

The ability of various bow components (primarily the riser) to resist the forces imposed by the deflecting limbs, along with loaded cables and bowstring, substantially affects the performance of the bow in terms of both arrow velocity and accuracy. Components that are not uniformly loaded or designed specifically to compensate for non-uniform loads tend to deflect or bend under load. Any such deflection, particularly in the riser, adversely affects both arrow velocity and accuracy.

Riser deflection is a component of hysteresis. Hysteresis is generally defined as the difference between the work done in drawing the bow and the kinetic energy of the arrow as it leaves the bow. Because hysteresis is commonly an assessment of static friction, the primary focus of those seeking to reduce hysteresis has been at the bearings on which cams or idler pulleys rotate. Bearings made from improved materials or antifriction bearing such as roller or ball type bearings have been employed to reduce friction and have produced some reduction in hysteresis. However, the analysis of hysteresis in a compound bow cannot be limited to revolving or rotating components alone. Some portion of the static hysteresis of a compound bow is attributable to the components of the bow, such as the riser, deflecting under the imposed loads. In a compound bow, due to limitations necessary to provide clearance for the arrow, cables, and other elements, a degree of offset and non-balanced loading is perceived to be unavoidable in the design of compound bows. One example is that of the spacing of the tracks of the lobes of the cam that carry the cables and bowstring with respect to the center of the axle on which the cam rotates. During the drawing of the bowstring, loads in the bowstring change constantly and, simultaneously, loads in the cables change constantly as well, creating a constant transfer of loads from one side of the centerline of the axle to the other. This creates what is commonly referred to as cam lean, limb lean, or limb twist. Twisting limbs impose lateral loading on the riser at the limb pivot location of the riser as well as through the neutral axis of the riser via loads in the cables. This imbalance is aggravated by the need to offset that portion of the riser defining the arrow pass and sight window area. Further imbalance results from moving the cables that span from the upper to the lower limbs, crossing in the proximity of the arrow path, out of the way in order to provide clearance for the fletching of the arrow. This is commonly accomplished by a cable guard rod extending from the riser to the location of the cables and, by means of a sliding attachment, relocating the cables to a position clear of the arrow-fletching path. This relocation or offset of the cables creates an angular attitude of each cable with respect to the plane of the axle and thus a further load imbalance.

The adverse effect of non-balanced loading are not recognized as a component of hysteresis, although it is recognized as a factor with respect to accuracy. It is known that the deflection or bending that occurs in a riser—along with cam lean—affects the travel of the nock and thus the arrow path during launch. Any deviation from a perfectly straight path of the nock induces oscillation to the arrow and causes erratic arrow flight. Therefore, much attention has been devoted toward the design of risers, to resist bending under load to reduce cam-lean. As yet, however, no compound bow has been designed in which the results of unbalanced loading can be regarded as inconsequential.

As stated above, imbalanced loading of limb tips and subsequent limb twist is an inherent problem of prior art bows, whether of one or two cam design. On conventional one or two cam bows, this imbalance is a result of the necessity to orient the lobes of the cam(s) such that the bowstring and buss cables will be in their required positions laterally and the fact that the loads in the string and cables constantly change throughout the draw. This imbalance is further aggravated on conventional bows by the requirement to move the buss cables, which cross from top to bottom in the vicinity of the arrow pass, forcibly toward the string-hand side in order to clear the arrow fletching as the arrow passes the cables. In the bow example of my previous invention, adequate fletching clearance was achieved by means of locating the minor lobe of the cam off center and likewise setting the buss cable attachment point at the limb tip off center. However, this arrangement created a more pronounced imbalance at the limb tip and thus more pronounced limb twisting.

Yet another aspect related to the tendency of a bow riser to bend or deflect in an undesirable manner relates to the tendency of the upper and the lower portion of the riser to bend back toward the archer about the center or grip portion of the riser as a result of the force of the archer's grip in opposition to the forces of the limbs being deflected by the cables and bowstring. On conventional bows, the attitude of the mounting of the limbs is such that the limbs are more parallel to the vertical plane of the riser than parallel to one another with respect to their length. Thus the forces applied to the riser at the pivot point of each limb under deflection is directed back toward the archer and in opposition to the force applied to the grip portion of the riser by the archer. Additionally, forces in the buss cables directed from top to bottom and bottom to top of the bow add to the reaction of the riser about the pivot point at the grip.

Deflection or bending in the riser in this manner is likewise detrimental to both performance and accuracy and some attention has been given to the reduction of this effect. Risers have been designed with strut-like appendages that span or bridge from the top of the riser to the bottom in order to counteract these forces and reduce riser bending. The geometry of the bow of the present invention, however, provides a limb mounting configuration in which the limbs are more parallel to one another and more perpendicular to the vertical plane of the riser (this geometry was first disclosed in my previous patent). The geometry of the present bow also isolates limb and cable forces at either end of the riser, so the only forces now relevant to riser bending are those forces applied by the archer in drawing the bowstring. Since these forces alone represent far less that those which would be required to exceed the capability of the riser material to resist bending, it may be seen that the present bow all but eliminates undesirable riser bending.

All cables experience some permanent elongation when first loaded. Afterward, some additional, elastic stretch occurs each time an additional load is applied. The amount of initial elongation and subsequent elastic stretch is depends in part on the specific material used to construct the cable as well as its method of construction. Cable stretch causes undesirable effects in compound bows. The initial elongation that occurs allows limb tips and cam positioning to become displaced from their intended starting position at brace thereby altering the force/draw characteristics. One can compensate for initial, permanent elongation by pre-stretching the cable prior to installation. However, the elastic stretch that occurs thereafter remains and the amount of stretch is proportional to the length of the cable. Shorter cables absorb less energy than long ones, making more energy available to the arrow and thus improving arrow velocity. The buss cables of the bow of the present invention are approximately 80% shorter than that of conventional compound bows, and reduce the effect of elastic stretch to insignificant levels.

On a conventional two-cam type compound bow, the individual cams are directly linked by the bowstring and, with the buss cables from each cam resisting the force from the opposing limb; the cams tend to rotate together. However, owing to the geometry of the bow, the cams do not inherently work in perfect synchronization. Unless the bowstring is drawn from the precise center-point between the cams, which is not normally the case, the length of bowstring from the draw point to one cam will be different than that of the length of bowstring to the opposite cam. This causes one cam to rotate at a different rate from the other. A great deal of attention has been focused on cam synchronization within the art and a number of methods have been developed to improve cam synchronization in two-cam bows.

The most significant development aimed at eliminating problems related to cam synchronization was the one-cam bow, discussed previously. The simple fact that the one cam bow design has only one cam obviously eliminates cam synchronization as a problem. Nevertheless, the one-cam design presents a number of other problems related, in part, to cam timing, nock travel, bowstring and cable angles, unbalanced loading of the riser and other components, cam lean, and subsequent performance characteristics.

The limbs of a compound type bow typically are attached to the riser by a limb bolt which provides a way to adjust the limb pre-load tension in order to alter the peak draw weight of the bow. Conventional compound bows generally utilize one of two methods of anchoring the limb bolt.

The more common method is to pass the limb bolt through an opening in the limb located at the butt end of the limb and then to insert it directly into a threaded hole provided in the riser. While this arrangement is an economical way of providing adjustability, it has certain disadvantages. Because the bolt threads directly into the riser, the bolt is exactly perpendicular to the limb at only one point of adjustment. This point is usually where the limb is positioned such that the pre-load deflection of the limb provides the greatest available peak draw weight. From that point, the limb bolt (for each limb) may be unscrewed in order to reduce the pre-load and thereby provide a downward adjustment in peak draw weight. However, the amount of reduction is limited because, as the bolt is unscrewed the limb rotates about its pivot point resulting in an angular relationship between the fixed path of the bolt and the plane of the limb. While countersunk head type bolts are commonly used in conjunction with truncated washers to provide for some misalignment, the amount of available travel of the limb bolt is minimal before binding occurs either at the bolt head or between the body of the bolt and the side of the opening in the limb through which it passes. Although this arrangement provides adequate thread engagement to resist the forces imposed by the limb on the bolt and riser connection, it provides a limited range of adjustment making it necessary to use a bow press type device to assemble the bow and preload the limbs or to perform maintenance operations such as replacing a bowstring or cables. Furthermore, this arrangement is subject to the possibility of severe damage to the limbs or other components if the range of adjustment is exceeded.

The other method is designed to minimize the undesirable consequences that may arise from binding caused by an angular relationship between the limb bolt and the limb. In this method, the limb bolt passes through an opening in the butt end of the limb and uses a countersunk head bolt and truncated washer as above. However, instead of providing a threaded hole directly into the riser, a pocket type opening is provided in the riser through which the bolt may reach a cylindrical bar mounted laterally through openings in the sides of the riser and providing a threaded hole through the cylindrical bar to engage the threads of the bolt. This arrangement allows the bolt to pivot about the axis of the cylindrical bar such that a perpendicular attitude with respect to the limb may be maintained within the range of adjustment thereby avoiding binding. However, because a certain amount of material of the riser must be available above the openings for the cylindrical bar to resist the forces transmitted by the bolt, the cylindrical bar is restricted in terms of diameter thus providing a greatly reduced range of thread engagement and a restricted amount of adjustment in the limb preload. In this arrangement, the use of a bow press is also necessary, as no additional adjustment is made available. In fact, due to the limited range of thread engagement in this method, either extreme caution or some mechanical stopping means is required when reducing limb tension by unscrewing the limb bolts in order to avoid a bolt becoming disengaged from its anchor, resulting in an uncontrolled release of limb tension. The present invention provides a limb bolt adjustment means that eliminates the shortcomings of the previously described bows.

Nock travel is defined as the path that the arrow nock point on the bowstring takes as the bowstring is drawn by the archer, and subsequently the path that the arrow takes upon launch. Ideally, nock travel is virtually level and perpendicular to the riser when viewed from the side of the bow and defining a straight path, free of side-to-side movement, when viewed from the front of the bow. In prior bows, ideal nock travel is difficult to achieve for a number of reasons, one being that in most art bows, the nock point on the bowstring is not located at the center point between the limbs. Thus a greater length of bowstring below the arrow is affected by the draw than the bowstring above the arrow, resulting in an unlevel nock path when viewed from the side of the bow. Yet another reason for less than ideal nock travel is non-uniformity of components such as the cam and idler: this affects bowstring travel. In many cases, innovative cam designs, particularly in one-cam bows, have successfully achieved a relatively level nock path in relation to the bow as viewed from the side. However, the aspect of lateral nock travel, as viewed from the front of the bow and in relation to the vertical plane of the riser, has not been successfully addressed. Previously, it was mentioned that limb twist and riser deflection adversely affect both accuracy and performance. This can be directly related to lateral nock travel. In most conventional prior art bow designs, inherent limb twist, cam or idler lean, and lateral deflection of the riser caused by unbalanced loading results in the bowstring deviating from a straight lateral path. Upon launch of the arrow, this deviation manifests itself in the form of arrow oscillation affecting both performance and accuracy in an undesirable manner.

Considering the factors relating to compound bow performance, both recognized and unrecognized, it is evident that a bow which resolved factors related to unbalanced loading would result in a substantially improved arrow velocity, accuracy, and overall performance.

On any two-cam bow, cam synchronization is important. With conventional two-cam bow designs, where the arrow nock point is not located at the center of the bowstring between the limbs, cam synchronization is a problem in that the cams must be uniquely designed or provided with some form of adjustment so as to compensate for the unequal lengths of bowstring above and below the arrow nock point so that both cams can rotate in the appropriate relationship to one another and arrive at the proper ending (full draw) position at the appropriate time. Improper cam synchronization will result in a loss of both accuracy and efficiency.

SUMMARY OF THE INVENTION

An object of the present invention is to provide an extraordinarily compact, compound type archery bow.

Yet another object of the invention is to provide a compact archery bow that is capable of attaining a broad range of draw lengths.

Another object of the invention is to provide a compact archery bow that eliminates limb twist.

Another object is to provide a compact archery bow that provides an improved means of anchoring the limb adjustment bolts in a manner that affords an expanded range of limb adjustment as well as an added measure of safety.

Another object is to provide a compact archery bow that substantially reduces or eliminates the effects of imbalanced loading such as riser bending.

Another object is to provide a compact archery bow with unique features that provide improved efficiency and accuracy.

Another object is to provide a compact archery bow that minimizes recoil and noise upon launch of an arrow.

Another object is to provide a compact archery bow that does not require the use of a bow press type device for assembly or maintenance.

Another object of the present invention is to provide a compact archery bow that minimizes or eliminates cam timing and synchronizing problems.

Another object is to provide a compact archery bow that provides straight and level nock travel for improved accuracy and efficiency.

The present bow invention, by means of a unique geometry and design and location of components, addresses and successfully overcomes the problems associated with unbalanced loading in a compound type bow while providing additional improvements.

The present invention eliminates unbalanced load generation at cams located at the limb tips by mounting the cams to the riser and supporting them by means of -type side plates. By so doing, now the lobe of each cam that carries the buss cable which extends to the limb tip may be located directly in line with the centerline of the limb tip. Furthermore, the buss cable extending from each cam is directed now to the limb tip closest to the cam, rather than to the limb tip at the opposite end of the bow. Although locating the cams at the riser instead of at the limb tips is similar to that of the arrangement shown in my previous patents, there is a significant departure in that, in the previous invention, each lobe of the cam that carried the buss cable was offset from the centerline of the limb and each buss cable extended to the opposing limb. Now, each buss cable is anchored to the adjacent limb tip by means of a bracket configured such that an idler pulley to carry the bowstring may be located at the exact center of the axle. Thus all loads at the limb tip are perfectly balanced with respect to the centerline of the limb, completely eliminating limb twist. Because the buss cable extending from the upper mounted cam is directed to the tip of the upper limb and the buss cable extending from the lower mounted cam is directed to the tip of the lower limb, the buss cables do not cross near the arrow path, as in the prior bows, eliminating the need to move the buss cables to one side for clearance and thus eliminating any angular approach to the limb tip. For the same reason, the cable forces do not impose lateral forces on the riser, that would tend to create lateral bending therein. Now all forces resulting from limb deflection are counterbalanced. The only force that extends from the top of the bow to the bottom is that of the tension in the bowstring and therefore the riser is virtually free of any lateral bending during use.

In the bow of the present invention, the forces occurring at the pivot points of the limbs are directed such that the vertical mass of the riser acts to resist the forces because the limbs are oriented closer to perpendicular to the vertical plane of the riser rather than closer to parallel to the vertical plane as with most conventional bows. The vertical mass of the riser is more than adequate to resist the forces applied at the pivot points of the limbs when the forces are directed as described and when no other forces that are sufficient to induce bending, such as those imposed by the buss cables, are present. While some recent conventional compound bows have adopted the parallel limb configuration, which was first introduced in the bow of the previous invention, in order to reduce the vibration and noise that occurs as a result of the forward, recoiling motion of limbs when they are more parallel to the vertical plane of the riser, bending of the riser is not eliminated owing to the remaining influence of the buss cables.

The bow of the present invention uses a parallel limb configuration similar to that of the previous invention in concert with the unique buss cable routing, cam mounting means and other unique features to completely eliminate riser bending along with any adverse effects related to such bending.

The distinctively short axle-to-axle length of the bow of my previous patent as well as the bow of the present invention makes it impractical to utilize a cable guard rod, as on longer conventional bows, to relocate cables to achieve proper fletching clearance. Thus, it can be recognized that the unique orientation and direction of action of the cable components of the present bow completely solves the problems associated with limb twist and imbalanced loads that would result in undesirable lateral deflection in the riser or other bow components.

The benefits of eliminating riser flex are well known, with respect to accuracy improvement and the reduction of noise. However, the effects of riser bending on arrow velocity (beyond that which would commonly be expected in conjunction with improved accuracy) appear not to have been fully recognized. As stated previously, hysteresis represents an important factor with respect to arrow velocity. All known data dealing with hysteresis in bows deals specifically with the friction associated with rotating components as the sole factor in the loss of stored energy (in terms of the difference between the energy required to draw the bowstring and the energy that is actually available to the arrow). However, the loss of energy to friction associated to those components that are designed to rotate or otherwise move is not the only component of hysteresis. I have determined that a percentage of the loss of energy is directly related to the deflection or bending of those components of the bow, such as the riser, that are not intended to bend or deflect under load.

Procedures and implements for measuring the energy required to draw the bow and then the energy exhibited when the bowstring is returned to brace, and assigning the difference to hysteresis is well known to those within the art who routinely analyze the performance characteristics of bows.

In my research, I have tested various bows to measure deflection of components of each bow under normal loading conditions and to determine whether such deflection contributed to measured hysteresis. In these tests, each bow was secured in a fixture designed to allow the force/draw data to be obtained; this information was plotted into a curve from which the amount of energy required to draw the bow could be determined. Then, using the same procedure, the amount of energy to let the bowstring return to brace was obtained. The two energy values were then compared to determine the loss of energy. Each bow was then secured in another fixture fitted with dial indicators positioned at specific points about the riser and other components such that any deflection could be observed and noted in terms of magnitude and direction when the bow was normally loaded. Upon determining the deflections observed, each bow was then either fitted with rigid bracing designed to eliminate such deflection or fitted with a special substitute riser designed to eliminate the possibility of any deflection occurring as a result of the applied loads. Each bow, thus retrofitted, was returned to the first fixture where new comparison data with respect to energy loss was obtained. The results revealed that where the bending of the riser and other components was substantially reduced or eliminated altogether the loss of energy was reduced by approximately 15 percent—a significant reduction, considering the state of development of bow design.

The present invention provides pylon type anchor plates secured to each side of the riser extending to the location of the limb bolt engagement and further providing a mounting means for a limb bolt anchor component. Because the bifurcated configuration created by the side plate pylons provides a relatively unrestricted area in which to locate the limb bolt anchor means, the limb bolt anchors may be of a suitable diameter so as to provide for adequate thread engagement over a wide range of preload adjustment as well as a configuration that provides free rotation of the limb bolt anchor means about its axis thereby allowing constant perpendicular alignment with the plane of the limb and further eliminating the possibility of binding throughout an extended range of adjustment.

In the two previously described common methods of providing for limb bolt adjustment, a downward range of 10 to 15 pounds of peak draw weight is normally all that is available before danger of either thread disengagement or binding is likely to occur. In the bow of the present invention, the limbs can be fully unloaded while maintaining adequate thread engagement and without binding. The advantages of such a design are numerous. One advantage is that the bow provides a large range of draw weight options. Yet another advantage is that a bow press type device is not required to relax the limbs in order to perform maintenance tasks such as the replacement of a bowstring or cables. This means that the bow owner may safely perform these tasks eliminating the need to take the bow to others who possess a bow press or for the bow owner to purchase such an item. Another advantage, and one of substantial importance, is that of safety. Because the design of the bow of the present invention allows the limbs to be relaxed to an undeflected condition while maintaining adequate thread-engagement, the possibility of a limb becoming violently disengaged under load is eliminated.

In essence, this unique design for anchoring the limb bolts and providing for limb adjustment provides the adequate thread engagement as in the first common method, but with added range, along with the pivoting bolt feature of the second common method with the added feature of safe adjustability across an extended range up to and including the elimination of the need for a bow press.

Although my prior bows provided a riser with bifurcated ends allows for a cylindrical bar type limb bolt mounting, the restrictive nature of this configuration proved to prohibit providing all of the enhanced features and advantages provided by the separate pylon mounting arrangement of the present invention. While the pylon mounted limb bolt anchor configuration of the present invention is particularly suited to the design of the present invention, it also works in concert with the pylon type side plates that locate and support the cams and intermediate spools to achieve a balance and isolation of loads resulting from limb deflection. This feature could be readily adapted to convention compound bow designs as well, to achieve similar advantages.

An important characteristic of the present invention is that each buss cable is extends between the limb tip and the cam closest to that tip, as opposed to the cam at the opposite end of the bow. This improvement requires only a very short length of buss cable, which reduces cable stretch.

The bow of the present invention employs the means of synchronizing cables mounted to synchronizing cable spools to link the two cams in order to insure precise synchronization of cam rotation. Additionally, the bow of geometry places the point of draw of the bowstring virtually at the center-point of the distance between the limb tips and thus equidistance between the cams. The vertical location of the bowstring also coincides with the vertical centerline of the riser. These features insure that the synchronization of cam rotation is perfect and that the nock travel is level. It is well understood within the art that precise cam synchronization and a precisely straight arrow path during launch are critical factors with respect to arrow velocity and accuracy.

Cam timing, mentioned above, is different from cam synchronization in that the subject of cam timing relates to the proper starting position of each individual cam. A cam (in either the one or the two cam bow design) is designed to have a specific starting orientation relative to the limb in order to properly define the force draw characteristics of the bow. Any deviation from the designed starting orientation alters these characteristics in an adverse manner. Factors that affect cam timing on conventional bows are primarily associated with bowstring and cable length, of which the stretch in these components plays a significant role. On the one cam bow, this is a more significant factor than that on the two-cam bow due to the substantial difference in length between a buss cable and a bowstring that acts both as a bowstring and a buss cable. The bowstring, which is considerably longer than the cable, will stretch at a different rate than the cable altering the starting position of the cam. This inherent effect in the one cam bow design dictates that the position of the cam at brace must be frequently monitored and routine length adjustments made by removing and twisting the bowstring or the cable or both in order to return the cam to its proper starting position. In the two-cam bow, cable and bowstring stretch affect cam timing as well, usually allowing both cams to simultaneously go out of time to near the same degree. Because inherent imbalanced loading and cam synchronization problems are factors of concern as well in the conventional two-cam bow design, the addition of cam timing problems adds to the complexity of maintaining proper performance characteristics in the conventional two-cam compound bow.

The unique design of the bow of the present invention, however, substantially minimizes the possibility of cam timing problems. As previously described, the primary buss cables of the bow of the present invention are extremely short and thereby reduce the effects of cable stretch to insignificant levels. Additional cables used to connect the cams to the take-up-spools are also so short that stretch is not significant. The bowstring used in the bow of the present invention, while somewhat longer than that used in a conventional two-cam compound bow, is much shorter than that required on a conventional one-cam compound bow. However, with the cables eliminated as a factor leaving only the bowstring to affect timing, the bow of the present invention should require much less attention in this respect. Additionally, any timing adjustments that may be required are more easily executed as a result of the unique ability of the bow of the present invention to be safely un-tensioned without need of a bow press as discussed previously.

In my previous design, a cam located at the upper portion of the riser is connected by a buss cable to the lower limb tip, and a cam located at the lower portion of the riser is connected by a buss cable to the upper limb tip. Thus, the buss cables cross in the vicinity of the arrow path. This configuration dictates that clearance must be provided for the arrow fletching by some means. Moving the cables clear by means of a cable guard rod, as is normally done, is not practical in the case a bow having a dramatically short axle-to-axle length such as in my previous design as well as in the present invention. This is so because moving the cables in this manner creates an angular approach of the cable to the cam. On a conventional bow, with a much longer span of cable, the angle created is not significantly great and therefore does not significantly inhibit the travel of cable onto the cam lobe. An extremely short span of cable from the cam to the limb tip, however, would create a much greater angle from the guard rod to the cam lobe and result in an unacceptable angular feeding of cable onto the cam lobe resulting in cable wear and the possibility of the cable leaving the groove track of the lobe. Thus, the use of a cable guard rod to provide fletching clearance for the previous design (or the bow of the present invention) is not practical. The previous design provides for fletching clearance by offsetting the lobe of the riser-mounted cam that carries the buss cable toward the string hand side of the bow. However, unless the cable anchor position at the limb tip is offset in the same direction from the centerline of the limb as well, not only will the buss cable be in conflict with the rotation of the adjacent cam lobe, but adequate fletching clearance will not be attained. Offsetting both the cam lobe and the anchor point of the cable at the limb tip also produces unbalanced loading at the limb tip as well as forces on the riser that induce bending.

The bow design of the present invention overcomes the problem of providing arrow-fletching clearance by routing the buss cable from the upper cam to the upper limb tip and the buss cable from the lower cam to the lower limb tip and reversing the direction of rotation of the cams. By doing so, the lobe of the cam that carries the buss cable can be located at the center of the axle on which it rotates and in line with the center of the limb tip. The present invention further provides a bracket means for anchoring the buss cable at each limb tip whereby the cable load acts directly on the center of the limb tip and the idler pulley that carries the bowstring may be located at the exact center of the axle. This arrangement of buss cable routing allows all cable and bowstring loads to be perfectly balanced at the limb tips, eliminates any influence of cable loads through the riser, eliminates any arrow-fletching path obstruction, eliminates cable interference with the adjacent cam lobe, and provides a straight-line path for the cable travel onto the cam lobe.

The riser of the present invention also differs from my prior design. In my prior bows, the riser had a grip section, an arrow path section, and a sight window section defining the mid portion of the riser with an integral, bifurcated section located at the upper and lower end of the riser to locate and support the cam and spool/wheel components. The bifurcated section at each end was formed as an integral part of the riser. This represents an undesirable configuration from the standpoint of manufacturing cost and bow performance. The process of creating integral bifurcations at each end of the riser requires complicated machining processes and tools adding substantially to the cost. With respect to performance, the integral bifurcations dictate that the limb at each end of the riser is supported by and acts directly on the two sides sections defining the bifurcation. Thus, the loads imposed at the pivot point of the limb are not in balance with the centerline of the riser and therefore induce bending in the riser. As previously discussed, bending in the riser is detrimental to both arrow velocity and accuracy. While conventional compound bows experience riser bending caused by offset cables and bowstring, cam lean, offset limb pockets, and the like, is of greater importance to minimize or eliminate such in a bow of ultra-short design.

A further improvement relating to the riser and pylon type component mounting means relates to the orientation of the limbs with respect to the position of the cams. In the previous design, the center of each cam is located in close proximity to the pivot point of the limb near the body of the riser and, as discussed previously, connect to the opposing limb tip by a buss cable. The limbs are oriented such that they are near perpendicular to the vertical plane of the riser and near parallel to one another. This is a concept that was first introduced in the previous invention and is an ideal position for the limbs because the recoiling motion of each limb is countered by the opposing limb thus reducing recoil and noise. This limb positioning is maintained in the present invention. However, the pivot point of each limb is now repositioned to allow the use of longer limbs. Further, the present invention uses the side plate pylons to locate the cams in closer proximity to the limb tips. This improved configuration increases the angle of the buss cable from the cam to the limb tip with respect to a plane that would define an undeflected limb. In the previous design, this angle is of a degree that it is within the range of the most efficient use of the relationship of parallel and perpendicular forces in the deflected limb. With the rerouting of the buss cables as defined by the present invention and the use of independent pylon mounting plates, however, it is possible to reposition the cams such that the optimum cable-to-un-deflected limb angle is achieved. The positioning of the (riser-mounted) cam in order to appropriately define the optimum angle of the buss cable to the plane of the un-deflected limb represents an important consideration with respect to the design of the cam lobes in terms of influencing limb deflection and the translation of energy to the bowstring and in order to optimize the design of the cam with respect to its influence on efficient storage of energy. In the previous design, relocating the cam in order to achieve the optimum location in this respect is impractical by virtue of the fact that such a modification would constitute further complexity to the riser from a manufacturing standpoint as well as an increase of loading on the riser that would cause bending. In the design of the present invention, the use of independent pylon type mounting means in conjunction with the improved buss cable routing allows for virtually unlimited freedom with respect to optimizing the orientation of the cam without creating adverse effects with respect riser deflection or cost of manufacture.

The present invention provides a number of improvements in compound bow design.

The buss cable acts in the centerplane of the limb pairs and the riser. Locating the idler wheel at each limb tip, at the center point between the limbs, also places the forces of the bowstring along the centerline of the bow. Thus, all of the forces acting on the limb tips are centered, completely eliminating any tendency of the limbs to twist or cant to one side due to imbalanced loads.

With the present invention, drawing the bowstring from its braced position extracts a length of bowstring from each bowstring spool causing the bowstring spool to rotate. The rotation of the bowstring spool, in turn, imparts rotation to the cam spool whereby the cam drive cable, which is anchored to the cam spool, is caused to be wound onto the cam spool and, simultaneously, extracted from the major lobe of the adjacent cam where the cam drive cable is entrained around the perimeter groove of the major lobe and anchored at an appropriate location on the cam body. The winding up of the cam drive cable onto the cam spool and off of the major lobe of the cam causes the major lobe to rotate and thus to rotate the minor lobe of the cam. The rotation of the minor lobe winds a buss cable, anchored at one end to the minor lobe, onto the minor lobe. The buss cable, being anchored by a buss cable anchor assembly to the location of the idler axle at the tip of the limbs at its opposite end, draws the limb tip toward the minor lobe as it is wound up onto the minor lobe. The movement of the limb tip toward the minor lobe represents a further deflection of the limbs from their preloaded position and storage of potential energy.

The lever arm ratio relationships of the major and minor lobes of the cam, in conjunction with the intermediate ratio of the intermediate spool assemblies, affects the transfer of energy stored in the limbs to the bowstring and thus defines the drawing characteristics as well as the energy delivered to the arrow during launch. The present invention redirects the influence of the upper cam to the upper limb and the influence of the lower cam to the lower limb as previously described. This redirection of the buss cables requires that the cams must rotate in the opposite direction from that of my prior invention; therefore, additional factors in cam design must be considered relating not only to the reverse rotation, but also to the location of the cam with respect to the adjacent limbs, to optimize the effect of the angular attitude of the buss cables to that of the angle of the limbs in what would be their undeflected position.

Another advantage of this invention relates to nock travel. The bow of the present invention provides for level nock travel that is free from both vertical deviation, and lateral deviation as well. This is accomplished by making the upper and lower cam, spool, and limb assemblies symmetrical: the arrow nock point on the bowstring is at the center point between the limbs, and the upper and lower cams are mechanically synchronized by means of a system of synchronizing spools and synchronizing cables connecting the upper and lower cam assemblies. And the absence of limb twist and riser deflection, along with the bowstring being located in line with the vertical centerline of the riser, assures that the bowstring will travel in a straight line with respect to the vertical plane of the riser.

The problem of bowstring stretch is discussed above. The geometry of the present bow permits the use of cables that are not only of equal length, but also dramatically shorter that that of conventional prior bow designs. This results in a substantial reduction in the amount of cable stretch and therefore improves dynamic efficiency. The bowstring of the present bow, while substantially shorter than that of a one-cam bow, is somewhat longer than that of a typical two-cam bow. However, in the present bow, because a substantial portion of the bowstring is stored on the bowstring spool when the bow is in the braced condition, the free length of the bowstring at that point is relatively short. At brace, the tension in the bowstring is at its highest level. As the bow is drawn, bowstring tension progressively decreases to a point (at full draw) where the tension is at a minimum. Therefore, the effect of bowstring stretch is minimized. Since both bowstring stretch and cable stretch are reduced, in comparison to prior bows, a substantial improvement in efficiency can be realized.

As mentioned above, asynchronous movement of the cams in a two-cam bow adversely affects performance. The bow of the present invention insures proper cam synchronization by several means. As previously described, the upper and lower operating components are symmetrical, the nock point for the arrow is located on the bowstring virtually at the center point between the limbs, and a system of synchronizing spools and cables are provided to further assure that proper synchronization is maintained in the event that some form of imbalance is imparted by the archer pull.

BRIEF DESCRIPTION OF THE DRAWINGS

In the accompanying drawings.

DESCRIPTION OF THE PREFERRED EMBODIMENT(S)

Figure 1:
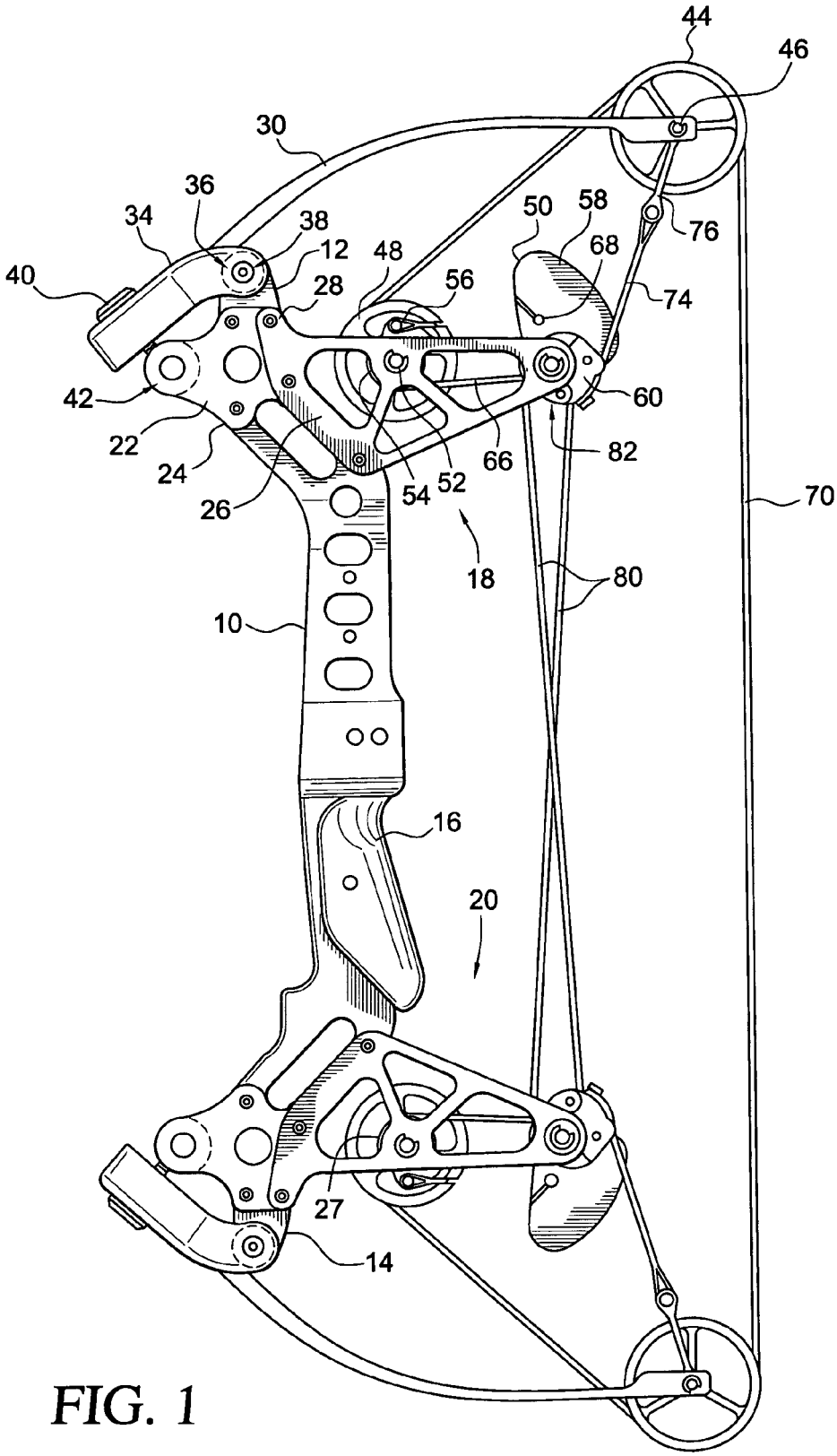
FIG. 1 is a side elevation of a bow embodying the invention, showing the parts in the bow's relaxed configuration.

As shown in FIG. 1, a bow embodying the invention comprises a riser or handle 10 having an upper end 12 and a lower end 14, with a hand grip 16 formed nearer the lower end. The configuration of the riser at its mid portion is similar manner to that of conventional archery bows, having an offset at the location of the arrow pass and the sight window. The configuration of the upper and lower portions of the riser provides clearance for the moving parts described below.

The riser's upper and lower ends support respective identical tensioning mechanisms 18, 20. Each tensioning mechanism includes a pair of anchor plates 22 attached to a respective end of the riser by screws 24, and a pair of side plates 26 overyling the anchor plates 22 and attached to the riser by screws 28. The riser and each of the plates have apertures formed therein to reduce weight.

At each end of the bow, two parallel limbs 30, 32 (FIG. 2) are seated in a pocket part 34. The pocket part has a bushing 36 through which a pin 38 passes, pivotally connecting the pocket part to the end of the riser. The angular position of the pocket, and thus the limbs, can be adjusted by turning a bolt 40 whose threads engage a threaded hole in a transverse anchor 42. The anchor has round ends which are received in round holes in the anchor plates, so that it can rotate about its axis as the limb geometry changes, preventing the threads becoming misaligned and causing the bolt to bind. The anchor has a diameter sufficient to provide adequate thread engagement between the bolt and the anchor over the entire range from no limb preload to the maximum permissible limb preload. This way, the bolts can be safely unscrewed until the limbs are fully relaxed, permitting disassembly of the bow without the danger of unexpected energy release, and without requiring the use of a press during disassembly.

An idler wheel 44 is supported on an axle 46 between the distal ends of the limbs 30, 32.

Each pair of side plates 26 support between them a bowstring spool 48, which is mounted on a common axle 52 with a cam spool 54, and has a bowstring anchor lug 56.

The side plates also support a cam assembly 50 which has a major lobe 58 and a minor lobe 60. The lobes are secured to each other laterally by screws so that they turn in unison.

Figure 5:
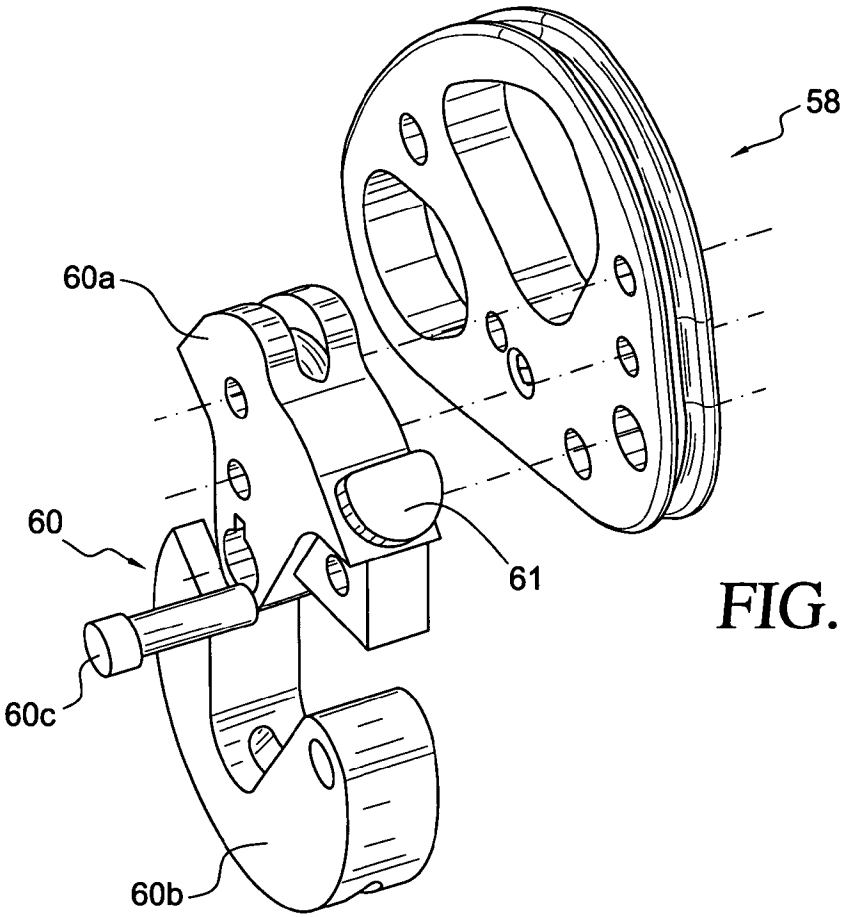
FIG. 5 is a perspective view of a cam assembly shown in the preceding figures.

As one can see from the detail view of FIG. 5, the minor lobe 60 is an assembly of two parts 60*a*, 60*b*, which are held together by a single screw 60*c*. The lower part 60*b* can be replaced with another module of different geometry to alter the draw-force curve. The upper part 60*a* has a lug 61 over which one end loop of the buss cable 74 is placed. From the lug, the cable ends extends around the cam in the groove in minor lobe 60, thence to buss cable bracket 76 (described below), where its other end is secured.

The bowstring spool 48 and the cam spool 54 are interconnected, and turn in unison. The cam spool and the cam are interconnected by a drive cable 66, one end of which is wound on the cam spool. The other end of the drive cable extends around a groove 67 in the periphery of the major lobe 58 of the cam and has a terminator which seats in a hole 68 in the cam.

The bowstring 70 has eyes at either end; these are anchored by the respective bowstring anchor lugs 56. The bowstring runs in the bow's center plane "B" from the upper anchor lug, around the perimeter of the upper bowstring spool 48, thence around a portion of the grooved perimeter of each idler wheel 44, and finally around the lower bowstring spool to its anchor lug.

Figure 2:
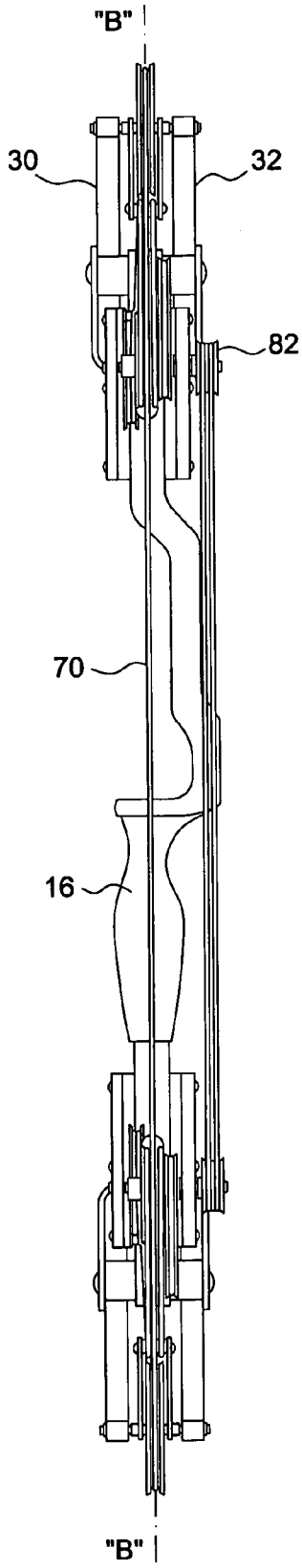
FIG. 2 is a rear elevation thereof.
Figure 3:
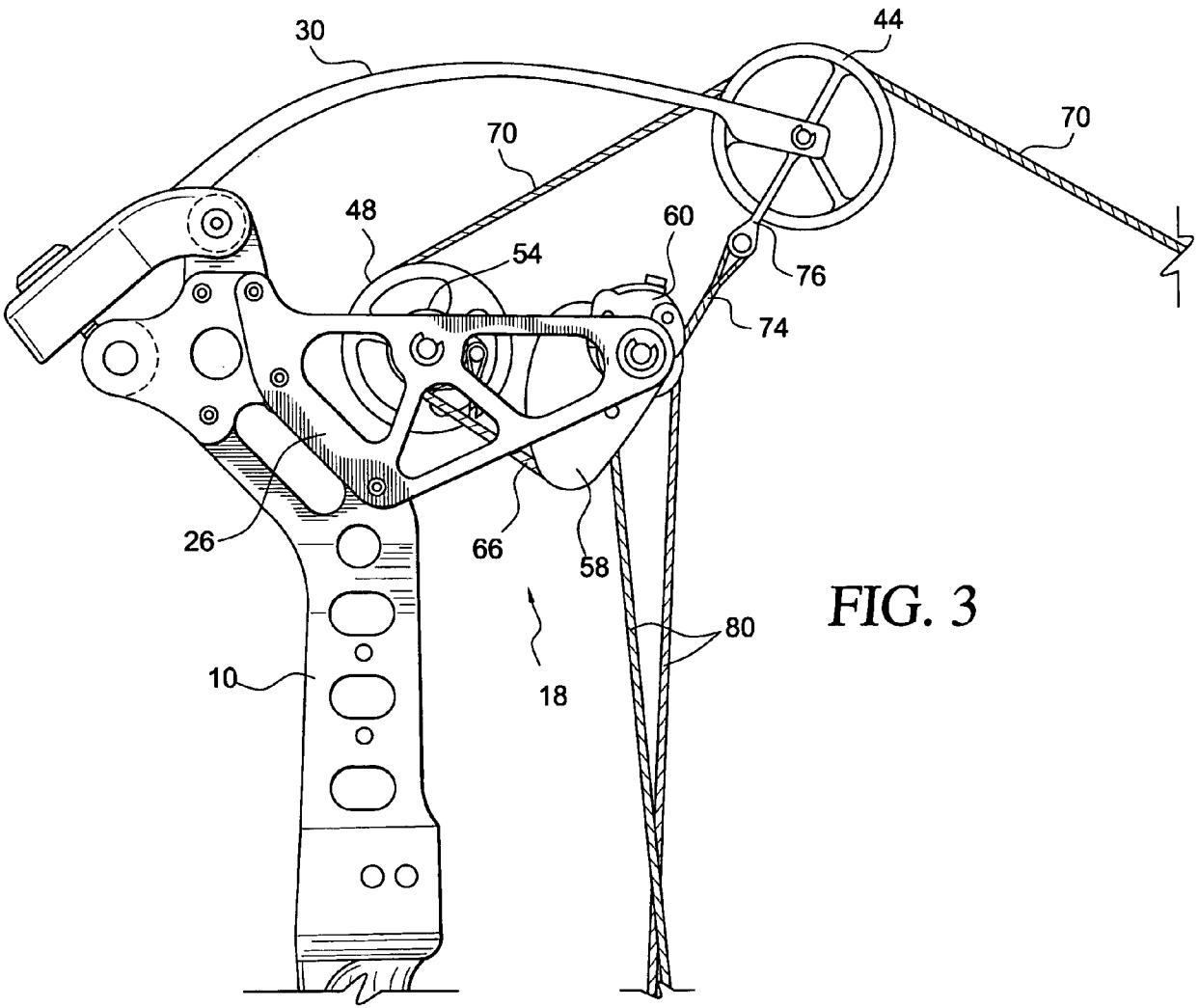
FIG. 3 is an enlargement of a portion of FIG. 1, showing the parts in a drawn configuration.
Figure 4:
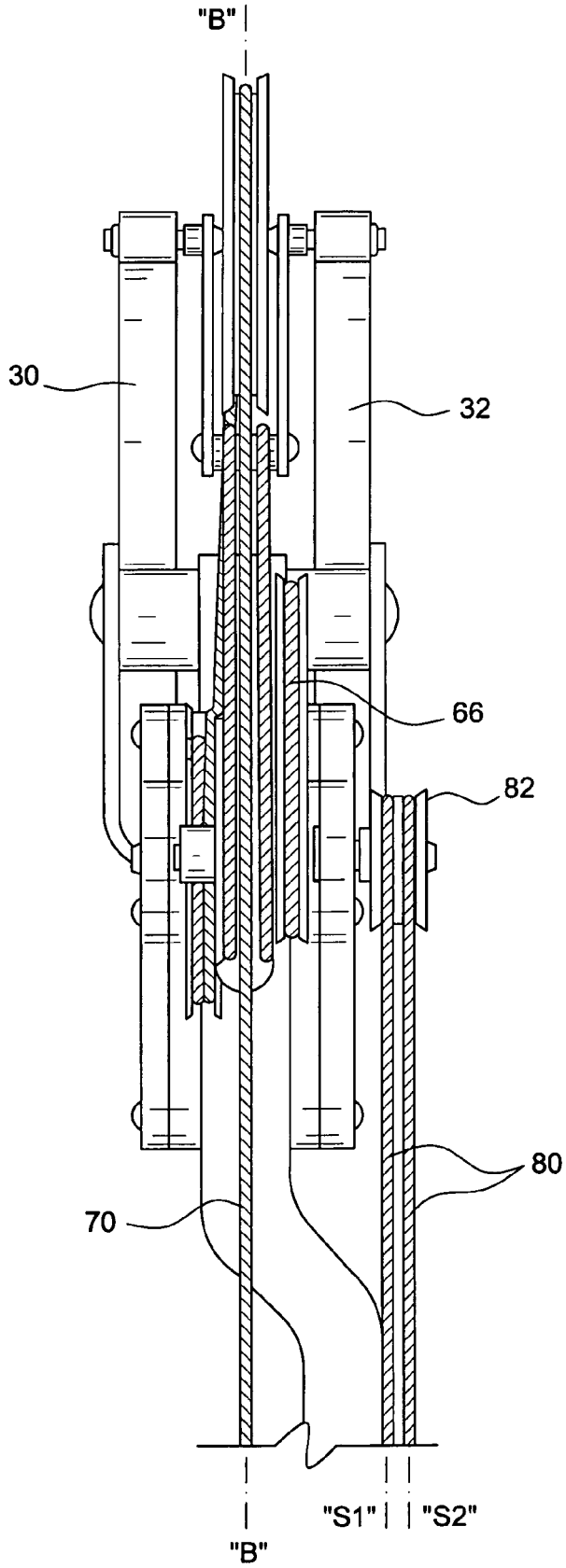
FIG. 4 is an enlargement of a portion of FIG. 2.

At either end of the bow, a buss cable 74 connects the minor cam lobe 60 to the distal end of the flexible member. Each cable extends in plane "B" from the minor lobe towards the respective idler wheel. Each end of the buss cable is formed in a loop. One end, as mentioned above, is placed over the lug 61 on the minor cam; the other terminates at a bracket 76 which has spaced arms 78 straddling the idler wheel and connecting to the axle 46 on either side thereof (FIG. 2). The spaced distal ends of the limbs 30, 32 also straddle the idler wheel, outboard of the bracket.

The bowstring and the buss cable are preferably made of strong synthetic fibers, while nylon-coated steel cable is preferred for the drive cable.

The movement of the upper and lower cam mechanism is synchronized, so that their angular orientation is always equal and opposite, by two synchronizer cables 80, which run in grooves on spools 82 (FIG. 2). These cables run in closely adjacent planes S1 and S2, both to one side of the plane "B" of the bowstring. Each end of each cable 80 is fixed to one of a pair of opposed points on the respective synchronizer spools 82, causing them to turn equally in opposite directions at all times. This insures that the limbs 30 at either end of the bow are equally stressed.

Importantly, the intermediate spool assembly stores bowstring so that the bow can be made ultra-compact; it also drives the cam in a similar manner to that of the bow disclosed in my previous patent. In addition, the intermediate spool provides an intermediate pulley ratio, which improves the dynamic efficiency of the bow. The optimum diameter of the cam spool is a function of several factors including the size ratio between the major and minor lobes of the cam, the draw length, the limb deflection, the degree of cam rotation per increment of draw, the duty rate of the limbs, and the relative location of components. Improved dynamic efficiency results from maximizing the rate of speed of bowstring travel during arrow launch in relation to the speed of the limbs. In most compound bows, the cam geometry necessary to produce desirable energy storing characteristics actually slows the bowstring as the bowstring approaches the braced position during launch, a detrimental result which the present invention overcomes.

The cam's major and minor lobes 58, 60 are connected so as to rotate together. Each is proportioned to create a progressive sequence of lever arm ratios which, in conjunction with the intermediate spool ratio, provide the required energy storing characteristics. Aside from the intermediate spool ratio and the overall geometry of the bow of the present invention, the general design principles regarding the profile relationships of cam lobes are similar to those used to achieve desired draw/force characteristics in conventional compound bows. The connection of the minor lobe of the cam to the limb tip and buss cable and its bracket assembly deflects the limbs and stores energy in them as the buss cable is wound up onto the minor lobe during cam rotation.

From FIG. 1, one can see that the upper cam influences the deflection of the upper set of limbs while the lower cam influences the lower set of limbs. My previous patents (excluding any embodiment using flat wound coil type springs as the primary means of energy storage) and most prior bows had the upper cam influence the lower limb and the lower cam influence the upper limb. The problem with the prior arrangement is that the forces resulting from buss cable tension, in addition those generated at the pivot points of the limbs as a result of limb deflection, were directed through the riser from top to bottom, causing lateral deflection or bending in the riser, adversely affecting both performance and accuracy. In the present invention, however, buss cable forces and forces generated at the limb pivot points are isolated at the top and bottom portion of the riser and therefore are not applied to the riser in a manner that would cause the riser to deflect or bend.

This invention is subject to many variations and changes in detail. The bow described above, and shown in the drawings, should be understood to be just one embodiment of the invention described by the claims below.

I claim:

1. A compound archery bow comprising a substantially inflexible riser having a grip for the hand of an archer, and, at either end of the riser:

a flexible member comprising at least one limb having a proximal end connected to the riser and a free distal end;

a freely rotatable idler pulley supported at said distal end;

a pair of side plates connected to said riser on opposite sides thereof;

said side plates supporting a mechanism comprising a first axle extending between the side plates, a spool assembly comprising a bowstring spool and a cam spool mounted for unitary rotation on said first axle, said cam spool being smaller in diameter than said bowstring spool, a second axle extending between the side plates, a cam assembly comprising a major lobe and a minor lobe mounted for unitary rotation on said second axle, a bowstring having two end portions and an intermediate portion, each end portion being wound on a respective one of the bowstring spools, and said intermediate portion extending around each idler pulley, two drive cables, each extending from a first termination on the cam spool to a second termination on the major lobe, a buss cable extending from a first anchor on the minor lobe to a second anchor connected to the distal end of the limb, whereby, when the bowstring is drawn by the archer and bowstring is drawn from the bowstring spool, the drive cable is wound onto the cam spool and withdraw from the major lobe, thus turning the cam assembly and drawing the buss cable onto the minor lobe, which flexes the limb toward the minor lobe.

2. The invention of claim 1, further comprising means for synchronizing the two mechanisms.

3. The invention of claim 2, wherein said synchronizing means comprising two synchronizer spools, each connected to a respective one of the cams for unitary rotation therewith, and two synchronizer cables interconnected to diagonally opposite points on said synchronizer spools.

4. The invention of claim 3, wherein the synchronizer spools are laterally offset from the plane of the bowstring so that the synchronizer cables do not obstruct the path of an arrow fired from the bow.

5. The invention of claim 1, wherein the cam spool has a smaller diameter than the bowstring spool, whereby the drive cable has a greater tension than the bowstring.

6. The invention of claim 1, wherein the limbs are supported at the ends of the riser by respective receptacles in which the proximal ends of the limbs are seated, said receptacle being pivotally connected to a respective end of the riser.

7. The invention of claim 6, further comprising a pair of mechanisms, one at either end of the bow, for adjustably preloading the limbs, each said mechanism comprising a pocket part for holding one end of one of the flexible members, said pocket part being pivotally connected to a respective end of the riser, a pair of spaced anchor plates secured to the riser, one either side thereof, an anchor supported by said anchor plates, said anchor being rotatable about its longitudinal axis and having a threaded hole transverse to said axis, a bolt passing through a hole in said limb pocket and having a threaded portion engaging said threaded hole, whereby the pocket part can be pivoted with respect to the riser to alter limb preload by turning the bolt.

8. In a compound archery bow having an inflexible riser interconnecting a pair of flexible members which support a bowstring and which are flexed when the bowstring is drawn, the improvement comprising a pair of mechanisms for adjustably preloading the limbs, each said mechanism comprising a pocket part for holding one end of one of the flexible members, said pocket part being pivotally connected to a respective end of the riser, a pair of spaced anchor plates secured to the riser, one either side thereof, an anchor supported by said anchor plates, said anchor being rotatable about its longitudinal axis and having a threaded hole transverse to said axis, a bolt passing through a hole in said limb pocket and having a threaded portion engaging said threaded hole, whereby the pocket part can be pivoted with respect to the riser to alter limb preload by turning the bolt.

9. A compound archery bow comprising a substantially inflexible riser having a grip for the hand of an archer, a pair of flexible members, one at either end of the riser, each flexible member having a proximal end secured to the riser and a free distal end, a pair of idler pulleys, each supported at the distal end of a respective one of said flexible members, a pair of cam assemblies, one adjacent either end of the riser, a bowstring having opposite ends secured to the respective cam mechanisms and an intermediate portion extending over said idler pulleys, and a pair of buss cables, each connecting one of the flexible members to one of the cam mechanisms, the buss cables being arranged to connect each flexible member to the cam mechanism closer to that flexible member, whereby the buss cables do not cross, and their length is minimized, thus reducing cable stretch and improving bow efficiency.

10. A compound archery bow as recited in claim 9, wherein each cam assembly comprises a major lobe and a minor lobe fixed together, and the idler pulleys and the minor cam lobes are located in a common center plane, and the flexible members are centered about said center plane, whereby no lateral forces are generated on the flexible members, the pulleys or the cam assemblies when the bowstring is drawn rearward in said plane.

11. The invention of claim 10, further comprising two pairs of side plates, one such pair being connected to either end of said riser on opposite sides thereof, said side plates supporting the cam mechanisms therebetween.

* * * * *

UNITED STATES PATENT AND TRADEMARK OFFICE

CERTIFICATE OF CORRECTION

PATENT NO. : 7,047,958 B1
APPLICATION NO. : 10/653284
DATED : May 23, 2006
INVENTOR(S) : Colley It is certified that error appears in the above-identified patent and that said Letters Patent is hereby corrected as shown below:

In column 9, line 17:

The present invention eliminates unbalanced load generation at cams located at the limb tips by mounting the cams to the riser and supporting them by means of "-type" side plates.

should read

The present invention eliminates unbalanced load generation at cams located at the limb tips by mounting the cams to the riser and supporting them by means of -- pylon-type -- side plates.

Signed and Sealed this

Fifteenth Day of August, 2006

JON W. DUDAS
*Director of the United States Patent and Trademark Office*